United States Patent [19]

Jayne

[11] 4,179,176

[45] Dec. 18, 1979

[54] CIRCUIT BOARD CONNECTOR

[75] Inventor: Max L. Jayne, North Warren, Pa.

[73] Assignee: GTE Sylvania Incorporated, Stamford, Conn.

[21] Appl. No.: 909,136

[22] Filed: May 24, 1978

[51] Int. Cl.[2] ..... H01R 13/62

[52] U.S. Cl. ..... 339/74 R

[58] Field of Search ..... 339/74 R, 75 MP, 176 MP

[56] References Cited

U.S. PATENT DOCUMENTS

| | | | |
|---|---|---|---|
| 3,130,351 | 4/1964 | Giel | 339/74 R |
| 3,639,888 | 2/1972 | Pittman et al. | 339/75 MP |
| 3,693,135 | 9/1972 | Vavrick et al. | 339/75 MP |
| 3,710,303 | 1/1973 | Gallager, Jr. | 339/75 MP |

FOREIGN PATENT DOCUMENTS

| | | | |
|---|---|---|---|
| 2305096 | 10/1976 | Fed. Rep. of Germany | 339/75 MP |

*Primary Examiner*—Joseph H. McGlynn
*Attorney, Agent, or Firm*—Robert E. Walter

[57] ABSTRACT

A low insertion force connector for making electrical contact between a circuit board and an external circuit is provided. The connector includes a housing having longitudinal side walls forming a zone for receiving the circuit board. A plurality of contacts mounted within the zone have upper portions for contacting opposite sides of the circuit board. Lower portions of the contacts are mounted in the housing. A camming means is journaled for rotation about an axis substantially normal to the side walls and includes camming surfaces engageable therewith so as to move the side walls apart when the camming means is actuated. The contacts are operably associated with the respective sides of the housing so as to apply a negligible insertion force on a circuit board when the camming means is actuated.

16 Claims, 6 Drawing Figures

CIRCUIT BOARD CONNECTOR

BACKGROUND OF THE INVENTION

This invention relates generally to an electrical connector for printed circuit boards, and more particularly to an electrical connector wherein a low insertion force is applied to the circuit board when the circuit board is inserted into the connector.

Low insertion force or zero force connectors are well known and come in variety configurations. Many electrical circuits are printed, or otherwise formed on either or both surfaces of an insulating substrate. The boards or substrates are inserted into receptacles which are then interconnected to other circuit devices to form complex electronic devices. The board has a plurality of conductive pads or strips on the marginal portions thereof which make contact to a "chip" or circuit in the center portion thereof.

The connector includes contacts for engaging the strips of conductive material on the board and making electrical connection with external circuit. The external circuit may be in the form of a board having a plurality of openings therein with each opening coated with an electrical conductive material. To complete the electrical connection with the printed board, the board is inserted edgewise into a receiving zone to mechanically and electrically engage the contact points.

Since it is necessary to have many contact points for engaging the multiple conductive strips on the board, the force required to insert the board into the receptacle can be high even though the individual force exerted by one contact is low. Reduction of the force applied by the individual contacts against the circuit board permits the use of a greater number of contacts for a given insertion force.

Insertion of the board in the connector tends to wear away the terminal strips on the board and deteriorate the contacts. This may be detrimental to both the electrical and mechanical integrity of the system. This tends to reduce the useful life of the connector and the board. The contact and terminal wear may necessitate early replacement of parts and contribute to expensive equipment failures.

An example of one type of known low insertion force connector can be found in U.S. Pat. No. 3,899,234 to Yeager, et al. An elongated contact drive member is positioned at the bottom of an aperture and a cam is arranged to move therein. The connector is arranged for the cam movement to drive the contacts into engagement with the board or drive the cams to an out of engagement position.

U.S. Pat. No. 3,478,301 to Conrad, et al. utilizes a system wherein insertion of the printed circuit board into the receptacle actuates cam members to displace the contact members to electrical engagement with the circuit board.

U.S. Pat. No. 4,060,300 to Jayne relates to the type of connectors wherein actuated plates are moved along the longitudinal axis of the connector to force the opposing contact holders apart.

Accordingly, it is an object of the present invention to provide a new and improved zero or low insertion force connector for circuit boards.

Other and further objects of the present invention will become apparent from the following description.

SUMMARY OF THE INVENTION

In accordance with the principles of the present invention there is provided a low force connector for making electrical contact between a circuit board and an external circuit comprising a housing having two longitudinal and substantially parallel side walls forming a zone for receiving the circuit board. A plurality of contacts which are mounted within said zone in spaced apart rows have upper portions for contacting opposite sides of the circuit board and lower portions for making electrical contact with an external circuit. A camming means is journaled for rotation about an axis substantially normal to said side walls and includes camming surfaces engageable therewith so as to move said side walls apart when said camming means is actuated. The contacts are operably associated with respective sides of said housing and are adapted to apply a low insertion force pressure on said circuit board when said camming means is actuated.

Also is provided a housing for an electrical connector comprising a base having a plurality of apertures therein, a pair of side sections, each pivotably mounted to said base and movable from an upright position to an open position, and a pair of top sections with each top section pivotably mounted to the other end of said side section.

DETAILED DESCRIPTION OF THE INVENTION

Figure 1:
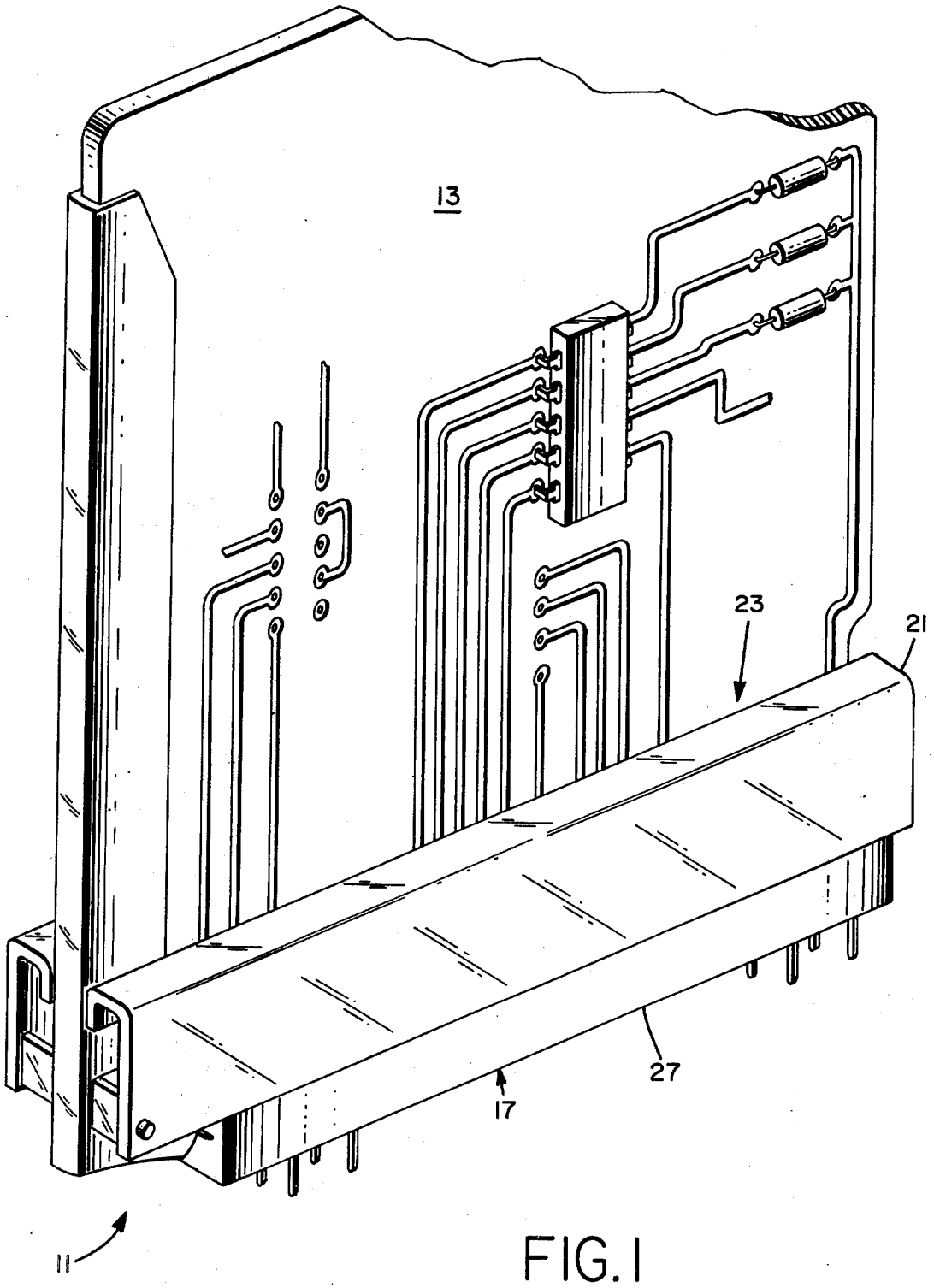
FIG. 1 is a perspctive view of the connector showing the connector and a circuit board.
Figure 2:
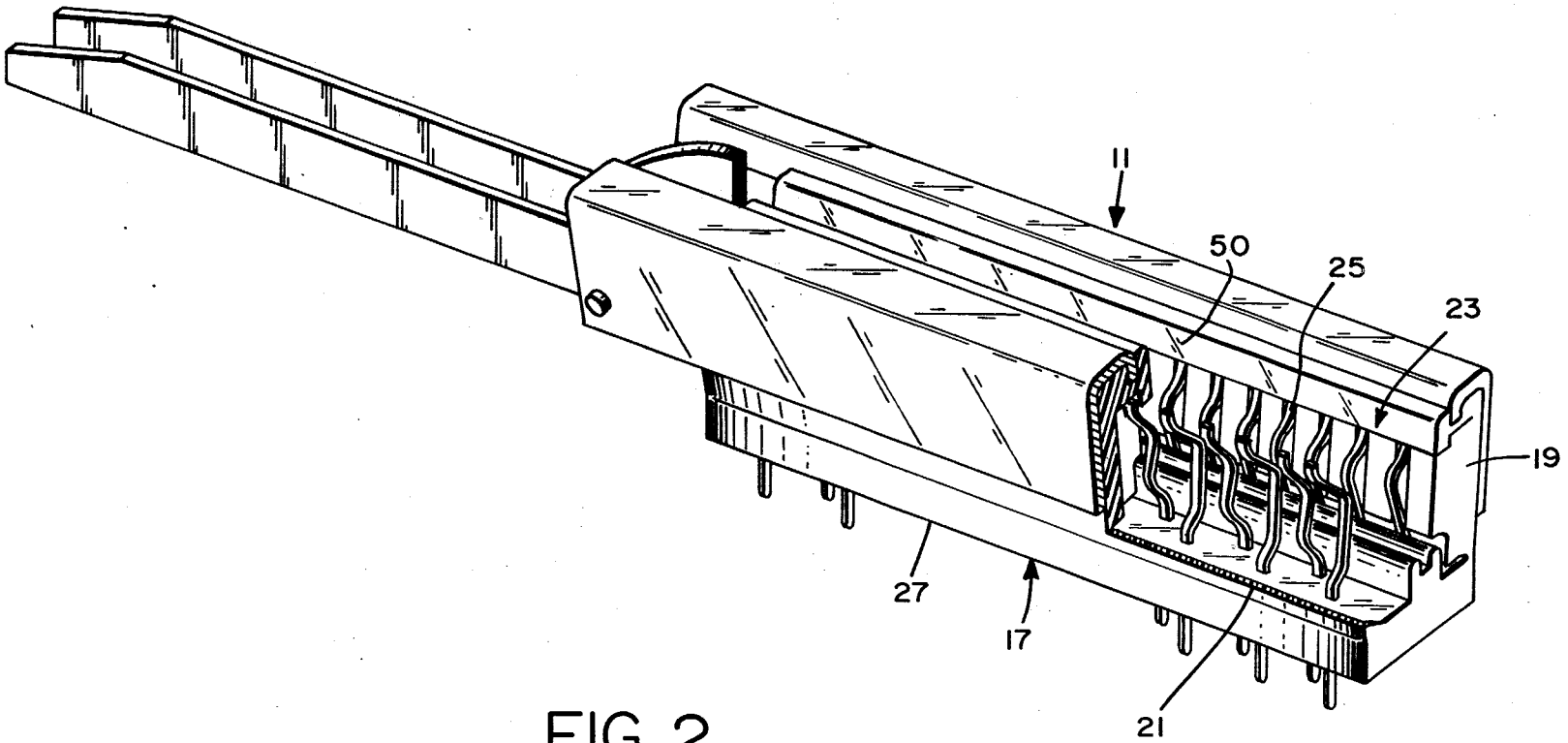
FIG. 2 is a perspective view of the connector showing the connector in an open position.

As shown in FIG. 1, a connector 11 is provided for making electrical contact between a circuit board 13 and an external circuit (not showing). The circuit board 13 is a conventional type integrated board having a circuit chip located in the center portion on one side of the planar substrate. Leads which provide for electrical connection radiate from the chip terminate at the edges of the substrate. Various substrates having different configurations may be utilized with the connector of the present invention. The substrate illustrated in FIG. 1 is of generally rectangular shape with parallel faces meeting side surfaces to form an edge.

The connector 11 generally comprises a housing 17 having two longitudinal and substantially parallel side walls 19, 21, forming a zone for receiving an edge of the circuit board 13. Installation thereof into the housing 17 is performed by moving the substrate in a direction substantially along its plane and into a receiving zone 23 so that the side walls 19, 21 are positioned on either side of the circuit board 13.

Figure 5:
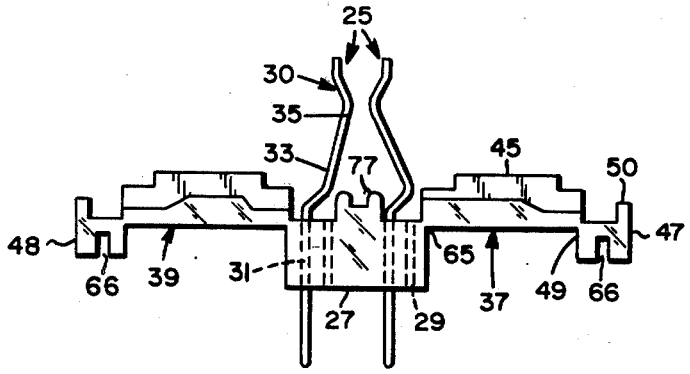
FIG. 5 is an end view of the hinged portion.
Figure 6:
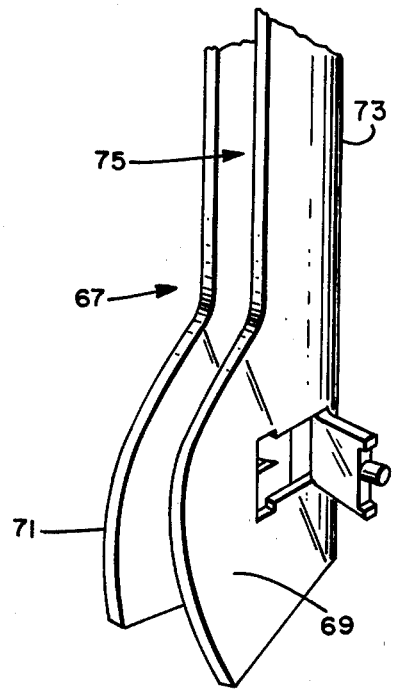
FIG. 6 is a perspective of the cam.

A plurality of contacts 25 are mounted within the zone 23 in spaced apart rows. The housing 17 includes the base 27 having a plurality of apertures 29 as illustrated in FIG. 5. A lower portion 31 on each of the contacts 25 is mounted within the apertures 29. As shown in FIG. 5, contact 30 includes a portion depending from the lower portion 31 and extending exterior to the base 27 for making contact with an external circuit. The external circuit can be the type having a plurality of bores coated with electrically conductive material and positioned along a plane within a substrate. Strips on the substrate are provided for interconnecting the selected plated bores to permit electrical interconnection.

As illustrated in FIG. 5 the apertures 29 into which the contacts 25 are mounted are arranged in a staggered array. Alternate apertures 29 are spaced a different amount from the longitudinal center of the housing 17. The present invention also contemplates the situation where the lower portion 31 of the contacts 25 are arranged in parallel rows. Due to the straggered array arrangement as showing in the drawings, the connectors include an offset section 33 connecting the lower portion 31 with a portion 35 which is provided for making contact with an inserted circuit board 15. The offset section 33 is formed so that the lower portions 31 of the contacts 25 are offset a given distance from the center line of the housing 17 while the sections 35 of the adjacent contacts are aligned for contacting opposite sides of a circuit board 13.

Figure 4:
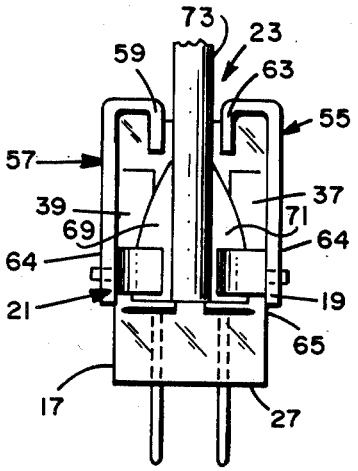
FIG. 4 is an end view showing the connector in a closed position.

Each of the side walls, 19, 21 include a respective side section 37, 39, pivotably mounted to the base 27 and movable from an upright position to an open position as illustrated in FIGS. 4 and 5. The pivotable mounting is in the form of a flexible hinge 65 which is adjacent the exterior surface of the housing 17 to permit unrestrained opening of the side sections 37, 39. With the side section 37, 39 in the open positon, the lower portion 31 of the contacts 25 can be mounted in the apertures 29 in the base 27. Each side section 37, 39 includes a plurality of vertically aligned partitions 45 along the length thereof for accommodating the contacts 25 in recesses formed thereby. As shown in FIG. 5 the side sections 37, 39 are moveable to an upright position so that the contacts are positioned between partitions 45.

The side sections 37, 39 have connected thereto and associated therewith a pair of top sections 47, 48. Top section 47 is pivotally mounted to the upper end of the side section 37 by a flexible hinge 49 positioned adjacent the exterior surface. Each top section 47 includes an overhanging lip 50 spaced from the hinge 49 a sufficient distance so as to project into the zone 23 when the side sections 37, 39 and respective top sections 47, 48 are in a closed position. The overhanging lip 50 engages the top portions of the contacts when the side sections 37 and 39 are closed. This engagement results in a biasing of the side sections 37, 39 in a closed position.

As illustraed in the drawings, each of the side walls, 19, 21 has associated therewith a reinforcing member 55, 57 which are in the shape of a channel. Each of the reinforcing members or channel members 55, 57 have one flange thereof secured to the exterior of a respective side section 37, 39. The flanges 59, 63 are connected by a bridge portion to the exterior flanges of respective channel members 55, 57. The flange 63 is mounted within a longitudinal groove 66 located in top section 47. The flange 64 which extends exterior to the side section 37 extends below the location of the flexible hinge 49 to provide stiffening thereof. Depending on the degree of stiffening desired to the housing, the lower end of the flange 64 can extend downwardly to the lower hinge 65. The channel member 55 grips the top section 47 between the flanges 63 and 64 so as to stiffen the side walls 19.

Figure 3:
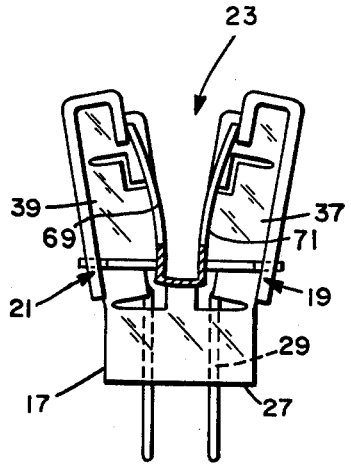
FIG. 3 is an end view showing the connector in a receiving position.

A cam means 67 is journaled for rotation about an axis substantially normal to the side walls 19, 20 and includes camming surfaces 69, 71 engageable therewith so as to move the side walls 19, 21 apart when the camming means 67 is actuated. As illustrated in the drawings, each of the side walls 19, 21 are formed so that the respective channel members 55, 57 extend lengthwise beyond the ends of the side sections 37, 39. Respective caming surfaces 69, 71 are journaled for rotation about an axis position in the lower portion of respective channel members 55, 57. The radial camming surfaces 69, 71 are adapted for engaging the inside surface of respective flanges 63, 59. Since each of the camming surfaces 69, 71 are circumferentially inclined outwardly from a plane substantially normal to the axis of rotation, the flanges 63, 59 are urged outwardly as the respective camming surfaces 69, 71 are moved from a first position shown in FIG. 4 to a second position shown in FIG. 3. In the first position, the radial surfaces 69, 71 are out of contact with the side walls 19, 21 so that substantially no outward pressure is exerted against the side walls 19, 21. In the second position, the radial surfaces 69, 71 contact the inside of side walls 19, 21 at an acute angle with the axis of rotation to urge the side walls 19, 21 outwardly.

The camming means 67 includes an arm 73 attached to the camming surfaces 69, 71. The arm 73 is movable from a first position substantially normal to the longitudinal walls 19, 21 to a second position exterior to the walls 19, 21 and substantially aligned therewith. The movement of the arm 73 from the first position to the second position causes the camming surfaces 69, 71 to move from their respective first position to their respective second positions as herein before described. With the lever 73 in an upright position (FIG, 4) the camming surfaces appear as a wedge with the apex of the wedge spaced from the lower base portion of the wedge. As the lever 73 is moved to a second position the base or expanded portion of the wedge moves into engagement with the flanges 63, 59 to cause outward movement of the side walls 19, 21.

The contacts 25 are operably associated with respective side walls 19, 21 of the housing 17 so that a low insertion force is applied on the circuit board 13 when the camming means 67 is actuated to move the side walls 19, 21 apart. As the upper portions of the side walls 19, 21 are moved apart the overhanging lip 50 engages the upper portion of the contacts 25 so as to move the contact away from the receiving zone 23. As a result, the pressure generated by the contacts 25 against an inserted circuit board 15 is substantially reduced or eliminated since the electrical contacting portions of opposing contacts are moved away from the zone 23.

In operation, the lever arm 73 is moved to a position in alignment with the side walls 19, 21 so as to urge opposing rows of contacts 25 apart to provide for a low force insertion of the circuit board 13. With the lever arm 73 in this position (horizontal), the edge of the circuit board 13 is inserted into the receiving zone 23 until the edge contacts stop member 77 protruding from the base 27. The lever arm 73 is then moved to a vertical position whereby the contacts 25 are returned to their circuit board engaging position. The lever 73 is provided with a hollow portion 75 which can be mated with the side edge of a circuit board 13 so that proper alignment of the circuit board 13 can be determined. The hollow portion 75 also serves as a support for the circuit board.

The designed intent and an alternate method of inserting circuit board 13 into receiving zone 23, is to place the edge of the circuit board in the hollow portion 75 of lever arm 73 when it is in the horizontal position. In this position it is in alignment with, and an extension of, the guide formed by raised edge portions of stop member 77. After thusly, positioning, slide the board horizontally into receiving zone 23 against an end stop (not shown) which provides initial alignment and subsequent registration of the conductive leads (strips) on the edge of the substrate with contacts 25 in the connector 17.

While the invention has been described herein with reference to certain examples and embodiment, it is to be understood that there are various changes and modifications can be made by those skilled in the art without departing from the concept of the invention, the scope which is to be determined by reference to the following claims.

What is claimed is:

1. A low insertion force connector for making electrical contact beween a circuit board and an external circuit comprising a housing having two longitudinal and substantially parallel side walls forming a zone for receiving the circuit board, a plurality of the contacts mounted within said zone in spaced apart rows, said contacts having upper portions for contacting opposite sides of the circuit board and lower portions for making electrical contact with an external circuit, a camming means journaled for rotation about an axis substantially normal to said side walls and having camming surfaces engageable therewith so as to move said side walls apart when said camming means is actuated, said contacts being operably associated with respective sides of said housing for movement therewith and adapted to apply a low insertion force on said circuit board.

2. A low insertion force connector according to claim 1 wherein said housing includes a base having a plurality of apertures and the lower portion of said contacts being mounted in said apertures, said side walls depending from said base.

3. A low insertion force connector according to claim 2 wherein said cam means includes a lever attached to said cam surfaces.

4. A low insertion force connector according to claim 3 wherein said lever is movable from a first position substantially normal to said longitudinal walls to a second position exterior to said walls and substantially aligned therewith.

5. A low insertion force connector according to claim 1 wherein said housing includes a pair of top sections, each top section extending from a side wall and including an overhanging lip on either side of said receiving zone, each overhanging lip being adaped to engage upper portions of said contacts.

6. A low insertion force connector according to claim 5 wherein each side wall is movable from a first substantially upright position wherein said contacts are biased inwardly for engagement with an inserted circuit board to a second position wherein said contacts are urged outwardly by each of the overhanging lips to provide for a low insertion force.

7. A low insertion force connector according to claim 6 wherein said camming means includes a lever, said lever is movable from a first position substantially normal to said longitudinal walls to a second position exterior to said walls and substantially aligned therewith, said lever first position corresponding to said side wall first position, said lever second position corresponding to said side wall second position.

8. A low insertion force connector according to claim 7 wherein said lever has a hollow portion which serves as a support for a circuit board when it is in the first position, and which further serves as a support and a guide for horizontal circuit board entry into the circuit board receiving zone when the lever is in its second position.

9. A low insertion force connector according to claim 1 wherein said cam surfaces comprise a pair of radial surfaces, each surface being adapted for engaging the respective inside surface of each longitudinal wall.

10. A low insertion force connector according to claim 9 wherein said radial surfaces are spaced apart at the axis of rotation a distance less than distance between said longitudinal walls.

11. A low insertion force connector according to claim 10 wherein each radial surface is circumferentially inclined outwardly from a position substantially normal to the axis of rotation.

12. A low insertion force connector according to claim 11 wherein each surface is movable from a first position to a second position contacting a respective inside surface along a plane at an acute angle with the axis of rotation.

13. A low insertion force connector according to claim 12 wherein said housing comprises an insulating member, said base being a part of said insulating member and having a pair of upwardly extending elongated side sections and further including a pair of channel members, each channel member having one flange secured to the outside of a respective side section and extending exterior to said insulating member, said cam surfaces being journaled for rotation between a lower portion of said flanges exterior to said insulating member.

14. A low insertion force connector according to claim 13 wherein each side wall includes a top section, said top section having a longitudinal groove therein for accommodating the other flanges of said channel member.

15. A low insertion force connector according to claim 14 werein said top section includes an overhanging lip, said lip being adapted to engage upper portions of said contacts.

16. A low insertion force connector according to claim 15 wherein each of said radial surfaces are combined by a respective flange.

* * * * *